US005110120A

United States Patent [19]

Smolucha

[11] Patent Number: 5,110,120

[45] Date of Patent: May 5, 1992

[54] BACK BOX LATCH FOR PINBALL GAMES

[75] Inventor: Walter Smolucha, Chicago, Ill.

[73] Assignee: Williams Electronics Games, Inc., Chicago, Ill.

[21] Appl. No.: 712,730

[22] Filed: Jun. 10, 1991

[51] Int. Cl.[5] ..... A63D 3/02; A47B 88/00

[52] U.S. Cl. ..... 273/121 R; 312/201; 312/251; 312/325; 312/327; 292/113; 292/247

[58] Field of Search ..... 292/113, 247; 273/118-125; 312/198, 201, 249, 271, 272, 293, 308

[56] References Cited

U.S. PATENT DOCUMENTS

| | | | |
|---|---|---|---|
| 4,326,739 | 4/1982 | Schlueter | 292/247 |
| 4,647,043 | 3/1987 | Wiczer | 273/121 R |
| 4,865,322 | 9/1989 | Kratsch | 273/121 R |

*Primary Examiner*—Edward M. Coven
*Assistant Examiner*—Raleigh W. Chiu
*Attorney, Agent, or Firm*—Rockey and Rifkin

[57] ABSTRACT

A latch for securing the hinged back box of a pinball game to a horizontal playfield cabinet engages a self-contained secondary tab when not engaging a locking tab on the back box preventing damage to the locking mechanism of the latch when the game is prepared for shipment.

4 Claims, 1 Drawing Sheet

FIG. 1
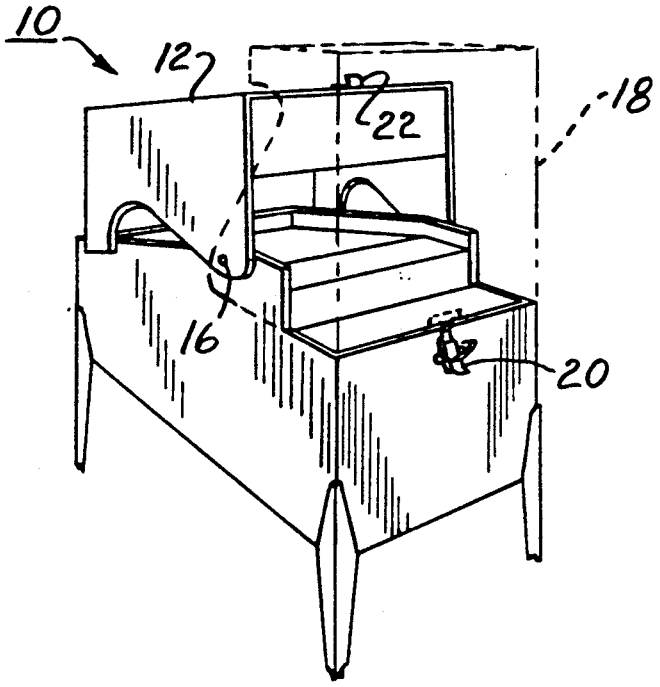
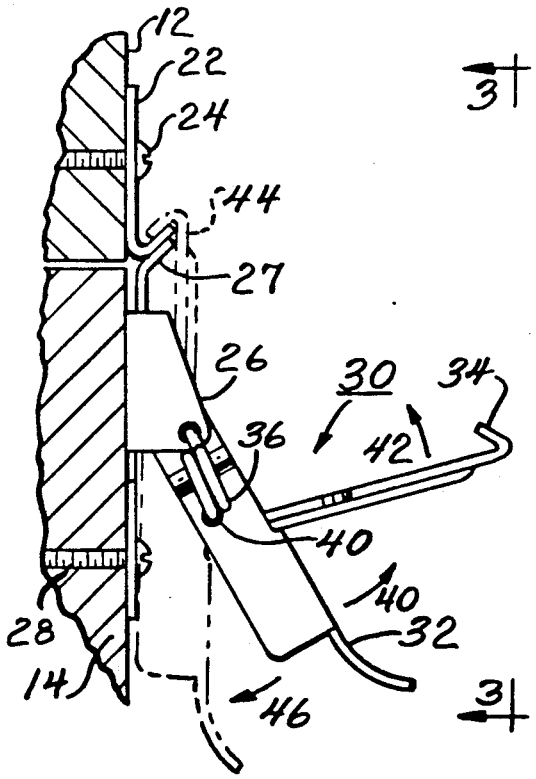
FIG. 2
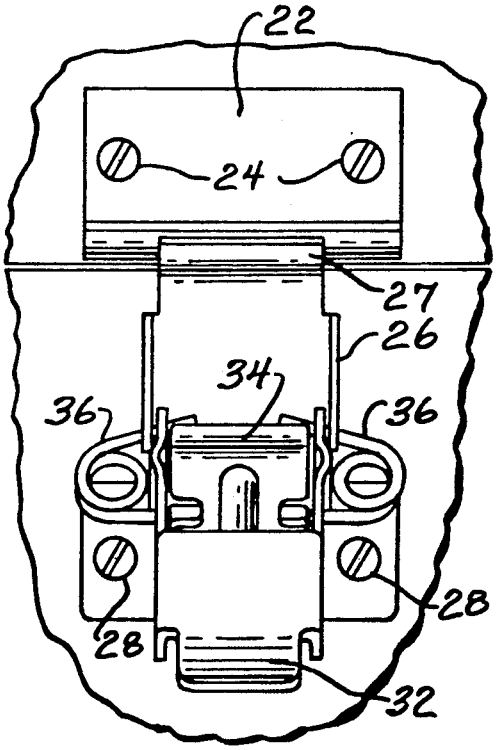
FIG. 3

BACK BOX LATCH FOR PINBALL GAMES

BACKGROUND AND OBJECTS OF THE INVENTION

The present invention relates to a securing mechanism and more particularly to a latch for securing a vertical portion of a pinball game (commonly called the back box) to the main playfield cabinet.

Pinball machines having a vertical back box pivotally secured to a horizontal playfield cabinet are commonly known in the art. Such a pinball machine is disclosed in U.S. Pat. No. 4,865,322 to Krutsch. In these games, the back box and playfield cabinet are hinged so that the back box may be folded into a position parallel to the playfield for shipment. Latches are employed to secure the back box to the playfield when the game is set up for play. These latches prevent the back box from being inadvertently pivoted toward the playfield. Latches commonly known in the art have linkage portions that are exposed (stick out) when disengaged and the back box is folded parallel with the playfield. Often, the exposed portion is damaged during movement of the game from location to location. If the latch is not repaired or replaced, the game can be damaged if used without securely latching the back box. In particular, the back box can tip over during game play. A latch having a linkage that is not susceptible to such damage is desirable.

Accordingly, it is an object of the present invention to provide an improved latch for pinball games having a back box pivotally mounted on a horizontal game cabinet.

It is another object of the invention to provide such a device in which the linkage is not susceptible to damage when not engaged.

It is a further object of the invention to provide such a device that is simple to use, and wherein the linkage is stored in a safe position when not in use.

It is yet another object of the invention to provide such a device having durable construction and low cost.

These and other objects of the invention will become apparent to those skilled in the art when the following detailed description of the invention is read in conjunction with the accompanying drawings.

SUMMARY OF THE INVENTION

The present invention is a latch for securing the hinged back box of a pinball game to a horizontal playfield cabinet. This hinged construction is employed so the game may folded into compact form for easy shipment. The latch is mounted on the playfield cabinet and has an over-center linkage that may engage an integral secondary tab when not engaging a locking tab mounted to the back box. By engaging the secondary tab, the linkage is not exposed to damage when the back box is disengaged during local transportation of the game from location to location or for servicing. Thus, damage to the latch is avoided to ensure that it is always available to prevent the back box from suddenly pivoting toward the playfield when the game is in use.

BRIEF DESCRIPTION OF THE DRAWINGS

FIG. 1 is a side view of a pinball game with a hinged back box having the latch of the present invention disposed thereon.

FIG. 2 is a side view in partial cross-section showing the latch of the present invention in an unfastened position, with a fastened position shown in phantom.

FIG. 3 is an end view of the latch of the present invention taken along lines 3—3 shown in FIG. 2.

DETAILED DESCRIPTION OF A PREFERRED EMBODIMENT

Referring to the drawings, FIG. 1 shows a pinball game 10 having a hinged back box 12 secured to a horizontal playfield cabinet 14 at a point 16. Dashed lines 18 show the orientation of the back box 12 in upright position. A latch 20 is secured to the back of the playfield cabinet 14 to engage a securing tab 22, which is mounted on the back box 12. When the latch 20 engages the securing tab 22, the back box is prevented from pivoting to a position parallel to the playfield cabinet 14, and thus the game is suitable for use.

FIG. 2 and FIG. 3 are useful in explaining the construction of the present invention. The securing tab 22 is mounted to the back box 12 by one or two screws 24. It should be noted that the bottom of the tab 22 is approximately flush with the bottom surface of the back box 12 to allow engagement with the latch of the present invention.

A latch body 26 is secured to the rear and of playfield cabinet 14 by screws 28. According to the invention, the latch body 26 includes a finger portion defining a secondary tab 27, the purpose of which will be described hereinafter. A latch mechanism 30 is pivotally mounted to the latch body 26. The latch mechanism 30 includes a handle 32 and a latch 34. A pair of spring pins 36 secures the handle 32 and the latch 34 for independent pivotal motion, as can be readily seen from FIG. 3. The latch 34 is secured for independent rotation about an axis 40.

In game play position, the back box 12 is pivoted to the upright position as shown in FIG. 2. In this position, the tab 22 is adjacent and above the secondary locking tab 27. The handle 32 is pivoted in the direction shown by the arrow 40 to move the latch 34 in the direction shown by the arrow 42 until it engages the tab 22. The handle 34 is then pivoted downwardly as shown by the arrow 46 to lock the latch into a position with the secondary tab 27 being sandwiched between tab 22 and latch 34.

An important feature of the present invention is the secondary tab 27. It allows the latch 34 to be secured out of harms way whenever the back box 12 is not in the position shown in FIG. 2. This means that the latch 34 is not left hanging loosely, as is the case with prior art latches. The latch 34 is thereby protected from damage such as breaking off when the game is moved, ensuring that it will be functional to hold the back box 12 in place when the game is subsequently reinstalled. Specifically, when the latch is disengaged from tab 22, the back box can be lowered. The latch is then operated as described above, but instead of engaging tab 22, it engages secondary tab 27. This keeps the pivoting mechanism from protruding rearwardly and possibly being damaged by contact with a wall or floor during local transportation of the game.

As can be seen, the latch of the present invention may be simply and inexpensively constructed. The locking tab and latch body are interchangeable with respect to position and either may be secured to the back box or the playfield cabinet. It prevents damage to the mechanism, ensuring that the latch is always available to lock the back box into game playing position.

The present invention has been described with respect to certain embodiments, which are not meant to limit the invention. Those skilled in the art will understand that variations from the embodiments and conditions described herein may be made without departing from the invention as set forth in the appended claims.

What is claimed is:

1. A playfield cabinet with a latch mechanism for securing a back box to the playfield cabinet comprising:

a) a playfield cabinet;

b) a back box hingedly secured to said cabinet for movement between horizontal and vertical positions;

c) a locking tab secured to one of said back box and said playfield cabinet;

d) a latch body secured to the other of said back box and said playfield cabinet, said body including:

i) a secondary tab attached to said body;

ii) linkage means for engaging:

(a) said locking tab to secure said back box in a vertical position;

(b) said secondary tab serving to protect said linkage means from damage when said back box is not secured in the vertical position.

2. The latch mechanism of claim 1 wherein said linkage means comprises:

a) a handle secured to said latch body for reciprocating motion, and;

b) a latch secured to said handle for reciprocating motion, said latch being brought into engagement with said locking tab or said secondary tab by reciprocating said handle and said latch.

3. The latch of claim 1 wherein said latch body is formed to include a finger portion defining said secondary tab.

4. In a pinball game having a back box hinged to a playfield cabinet so that said back box may be folded parallel to said playfield cabinet or opened to a vertical position, the improvement comprising:

a latch mechanism for securing the back box in the vertical position including a latch body mounted to one of said back box and said playfield cabinet, a locking tab mounted on the other of said back box and said cabinet, a secondary tab integral with said latch body, and a linkage means for engaging either said locking tab for securing the back box in the vertical position or said secondary tab to protect the latch mechanism against damage.

* * * * *